US010480257B2

(12) United States Patent
Downing

(10) Patent No.: US 10,480,257 B2
(45) Date of Patent: Nov. 19, 2019

(54) SYSTEM FOR RELIEVING LATERAL STRAIN ON A ROD STRING WITHIN A WELLBORE

(71) Applicant: Randy Downing, San Antonio, TX (US)

(72) Inventor: Randy Downing, San Antonio, TX (US)

( * ) Notice: Subject to any disclaimer, the term of this patent is extended or adjusted under 35 U.S.C. 154(b) by 24 days.

(21) Appl. No.: 15/703,853

(22) Filed: Sep. 13, 2017

(65) Prior Publication Data

US 2018/0073305 A1 Mar. 15, 2018

Related U.S. Application Data

(60) Provisional application No. 62/394,032, filed on Sep. 13, 2016, provisional application No. 62/394,053, filed on Sep. 13, 2016.

(51) Int. Cl.

| | |
|---|---|
| ***E21B 17/02*** | (2006.01) |
| ***E21B 17/10*** | (2006.01) |
| ***E21B 17/20*** | (2006.01) |

(52) U.S. Cl.

CPC ..... *E21B 17/02* (2013.01); *E21B 17/1071* (2013.01); *E21B 17/20* (2013.01)

(58) Field of Classification Search

CPC ..... E21B 17/20; E21B 17/1071

See application file for complete search history.

(56) References Cited

U.S. PATENT DOCUMENTS

| | | | | |
|---|---|---|---|---|
| 323,805 | A | 8/1885 | Griscorn et al. | |
| 2,010,587 | A | 8/1935 | Fisher et al. | |
| 2,687,024 | A | 8/1954 | Otis et al. | |
| 4,329,124 | A * | 5/1982 | Pridy | F04B 47/026 166/242.6 |
| 108,970 | A1 | 10/2015 | Baudoin | |
| 2012/0222506 | A1 * | 9/2012 | St. Denis | E21B 43/127 74/45 |
| 2015/0275610 | A1 * | 10/2015 | Tan | E21B 33/062 166/382 |

FOREIGN PATENT DOCUMENTS

| | | | |
|---|---|---|---|
| CN | 201083087 | Y | 7/2008 |
| CN | 201121492 | Y | 9/2008 |
| CN | 201723172 | U | 1/2011 |
| CN | 104389528 | A | 3/2015 |
| RU | 2307228 | C2 | 9/2007 |

* cited by examiner

*Primary Examiner* — Giovanna C Wright
*Assistant Examiner* — Brandon M Duck
(74) *Attorney, Agent, or Firm* — Robert L. McRae; Gunn, Lee & Cave, P.C.

(57) ABSTRACT

A system for relieving lateral stress on rods within a wellbore. A flexible sucker rod coupling has a top connecting member threadedly attached to a ball shank housing. The ball shank housing houses in a ball and socket fashion, a ball shank which extends out of the ball shank housing, defining a swivel gap to allow swivel movement. The ball shank is threadedly attached to a lower connection member. Both ends of the coupling threadedly attaches to an adjacent sucker rod within the wellbore. The ball shank is secured to the ball shank housing to ensure that the ball shank and the ball shank housing rotate together.

15 Claims, 4 Drawing Sheets

SYSTEM FOR RELIEVING LATERAL STRAIN ON A ROD STRING WITHIN A WELLBORE

This is a utility patent application claiming priority to U.S. provisional patent application No. 62/394,032 filed Sep. 13, 2016 and U.S. provisional patent application No. 62/394,053 filed Sep. 13, 2016.

BACKGROUND

Field of the Invention

The present application relates to a system for relieving lateral strain on a rod string within a wellbore, and more particularly to sucker rod assembly used inside the tubing of a well bore. In one aspect, the present invention provides a multi-pieced sucker rod assembly that provides relief from lateral strain imparted on adjacent sucker rod sections by providing a predetermined degree of swivel between said sections. The present invention can be utilized as a single unit, or multiple units may be placed along the sucker rod string of a well, to alleviate lateral forces and stresses on adjacent sucker rods where desired or needed. In one aspect of the invention, the sucker rod assembly is designed to threadedly attach directly to adjacent sucker rod sections. In an alternative embodiment of the present invention, the invention is designed to threadedly attach to a sucker rod coupling that is screwed into a changeover box. Another aspect of the present invention provides for a system for easily adjusting an adjustment rod adjacent a pump jack and connected to a polished rod above the wellbore, as well as relieve lateral strain placed on the polished rod by the pump jack.

Sucker rod assemblies have been designed in various configurations and used in the oil and gas production field to move fluid within the barrel of a well. One of the typical problems with the prior art is that the hydrostatic pressure on the down pump in the prior art causes lateral and oscillating movement with pumping can result in the parting of sucker rods or polished rods, requiring a rig to come in and pull all the rods, replace the sucker rods with new rods. All of this usually requires the well to be shut-in, costing time and money to the operator. The sucker rod assemblies and wells can extend thousands of feet below the surface, creating a long string of sucker rods. The sucker rods are typically threadedly attached to one another. As the well pumps, the polished rod above the wellbore move up and down, moving the string of rods accordingly within the wellbore. Rotational and torsional forces are exerted on the sucker rod string.

Moreover, the well bore in most situations is not completely straight and vertical. Therefore, the well bore itself may provide lateral strain on the sucker rod assembly as the wells pumping. All this can cause the sections of sucker rods to wear out due to the lateral forces, and may also result in separating of adjacent rods or parting of rods along the threaded attachments between the adjacent rods.

It is therefore desirable to create an attachment mechanism that allows for a predetermined degree of lateral movement or swivel between adjacent sections of sucker rods. Such an invention reduces and/or eliminates bending and breaking of polished rods, or adjacent sections of polished rods by allowing swiveling lateral maneuver.

It is further desirable to create a system that relieves lateral strain on rods within the wellbore while also creating an easily adjustable mechanism for relieving lateral strain on the polished rod above ground.

SUMMARY OF THE INVENTION

The present invention accomplishes these and other improvements. Specifically, the present invention provides a swivel mechanism to allow lateral movement of the adjacent sections of sucker rods with respect to the present invention, thereby relieving tension within the wellbore on adjacent sections of sucker rods or other pump rods.

In the preferred embodiment, the present invention provides a flexible sucker rod coupling which adjoins adjacent sucker rods thereto. The sucker rod coupling of the present invention comprises a top connecting member and a bottom connecting member, with a ball shank housing adjacently there between. The top connecting member comprises a top end with a recessed shoulder and internal threads for receiving the external threads of an upper sucker rod. The top connecting member substantially cylindrically shaped, and has interior threads along the upper portion thereof, just inferior to the recessed shoulder, to engage the threads of an upper sucker rod. The top connecting member comprises a midsection that has a recessed section along its external surface. The recessed section comprises four flat surfaces, which provide flat attachment surfaces for a tool such as a wrench, there by defining a wrench flat to attach the flexible sucker rod coupling to the adjacent sucker rods.

The top connecting member has a lower portion which comprises external threads which mate with internal threads of the ball shank housing. The lower portion of the top connecting member terminates in a socket which receives the ball of a ball shank. The ball shank housing is substantially cylindrically shaped, and comprises a top end which has internal threads to threadedly attach to external thread of the lower portion of the top connecting member. When the threads of the lower portion of the top connecting member are fully threadedly engaged with the internal threads of the ball shank housing, the socket resides within the ball shank housing at the appropriate location to receive the ball of the ball shank.

The ball shank housing comprises a lower portion which has a predefined aperture there through. The predefined aperture is designed to be a predetermined diameter wider than the shank or lower portion of the ball shank to provide a swivel gap to allow lateral or swivel movement of the ball shank and bottom connecting member relative to the top connecting member, thereby allowing swivel or lateral movement of the adjacent sucker rods to which the flexible sucker rod coupling is attached.

The ball shank comprises a shank or lower portion which extends through the aperture of the ball shank housing, and terminates in a threaded portion. The threaded portion comprises external threads. The external threaded portion of the ball shank is of a diameter substantially smaller than that of the threaded portions of the sucker rod connecting members of the top connecting member and the bottom connecting member. The ball shank has along its upper end a ball which engages with the socket of the top connecting member thereby forming a ball and socket joint.

The ball shank comprises a predefined number of holes along its circumference which correspond to predefined slotted apertures of the ball shank housing which are disposed along the outer circumference thereof and extend there through. A corresponding number of screws, pins or connection devices protrude through the slotted apertures of the ball shank housing and threadedly attach within the predefined holes on the circumference of the ball of the ball shank, and protrude through the slotted apertures of the ball shank housing. This ensures that as the rotational forces imparted on the sucker rods turn the sucker rods in a rotational fashion, the ball shank will rotate correspondingly to the sucker rods, and the flexible sucker rod coupling.

The bottom connecting member is substantially cylindrically shaped and comprises a sucker rod connecting member along its lower portion. The sucker rod connecting member comprises a recessed shoulder and internal threads for receiving the external threads of a lower sucker rod therein. On the end opposite of the sucker rod connecting member there is a ball shank locking thread. The ball shank locking threads are internal, and they receive the external threads of the ball shank. At the bottom of the ball shank locking threads, there is a lock. The lock engages the bottom portion of the ball shank below the external threads to lock the ball shank in to the bottom connecting member. The bottom connecting member comprises a recessed portion that comprise substantially flat surfaces to define a wrench flat, the same as the top connecting member.

In operation, determination is made as to where it is desirable to alleviate lateral strain and lateral forces on the string of sucker rods within the well bore. It should be understood that one, or any number of flexible sucker rod couplings may be used within a sucker rod string to alleviate lateral forces placed thereon. Where desired, the external threads of an upper sucker rod engages with the sucker rod connecting member of the top connecting member along its internal threads, and threadedly engages the top connecting member. With the ball shank housing threadedly engaged to the top connecting member, and the ball shank engaged with said socket, and rotationally locked with the pins or screws extending through the slotted apertures of the ball socket housing, the bottom connecting member is threadedly engaged to the threaded portion of the ball shank until the ball shank is locked within the lock at the bottom of the ball shank locking threads of the bottom connecting member.

The external threads of a lower sucker rod engage the sucker rod connecting member of the bottom connecting member, and threadedly engaged there in. As the rotational forces are imparted on the adjacent sucker rods, the flexible sucker rod coupling rotates correspondingly. However, because of the slotted apertures, and the predefined swivel gap which is defined by the space between the portion of the ball shank below the ball and the inner surface of the bottom portion of the ball shank housing, the ball shank is allowed to swivel laterally, providing lateral or swivel movement of the flexible sucker rod coupling. This allows for lateral movement or swivel movement with respect to be adjoining sucker rods, thereby eliminating lateral stress or substantially reducing lateral stress between the joints of sucker rods.

In another aspect of the present invention, a system for easily adjusting the interaction of the pump jack with a polished rod is disclosed. An adjustment rod adjuster comprises an adjustable load adjustment housing along an upper portion of a pickup adjustment rod. This load adjustment housing is designed to engage the pump jack and bears the load of the adjustment rod above the wellbore as the pump jack is operated in an upward and downward direction. A plurality of holes are disposed along the pickup adjustment rod at predefined increments. The predefined increments of apertures allow for adjustments of the load adjustment housing.

The load adjustment housing has at least two apertures that correspond to the apertures of the pickup adjustment rod. The load adjustment housing is substantially cylindrically shaped, and has an interior bore which receives the pickup adjustment rod there through. The load adjustment housing may slide directionally along the pickup adjustment rod until the apertures of the load adjustment housing are aligned with the desired location of the apertures of the pickup adjustment rod. Pins, bolts or other securing mechanisms are then placed through the holes of the load adjustment housing and the apertures of the pickup adjustment rod.

Thus, in operation, when it is desired to adjust the location of the interaction of the pickup adjustment rod with the pump jack, the pins are simply removed, the load adjustment housing is adjusted to the desired height, with the apertures aligning with the apertures of the pickup adjustment rod, and the pins or other securing mechanisms are then reinserted within said apertures to re-secure the load adjustment housing to the pickup adjustment rod.

The lower portion of the pickup adjustment rod is threadedly attached to an adjustment rod connector. The adjustment rod connector is substantially cylindrically shaped, and comprises a top portion that is internally threaded to receive the external threads of the pickup adjustment rod. Along a lower portion of the adjustment rod connector, the diameter decreases, and external threads are placed on a lower portion thereof. In one embodiment, the adjustment rod connector is directly threadedly engaged with a polished rod.

In another embodiment of the present invention, the lower portion of the adjustment rod connector comprises a socket for receiving a ball of a ball shank as previously disclosed. The adjustment rod connector is threadedly connected to a ball shank housing as previously disclosed. The ball shank housing's top portion has internal threads to receive the external threads of the adjustment rod connector. Disposed within the ball shank housing is a ball shank with predefined holes along the circumference of the ball and attachment screws which engage within the predefined slotted apertures to secure the ball shank to the ball shank housing, thus insuring corresponding rotational forces of the ball shank with the ball shank housing, as previously disclosed.

The ball shank comprises along its lower portion a collar and along the bottom portion of the collar, internal threads are placed to receive the external threads of a polished rod. Like the ball shank and the ball shank housing disclosed hereinabove, a swivel gap is defined by the space between the internal surface of the ball shank housing and the lower or shank portion of the ball shank, and provides lateral and swiveling movement between the pickup adjustment rod and the polished rod, similar to as described hereinabove.

DESCRIPTION OF THE DRAWINGS

FIG. 4 is a side partially exploded view of an alternative embodiment of the flexible sucker rod coupling of the present invention;

DESCRIPTION OF THE INVENTION

Figure 1:
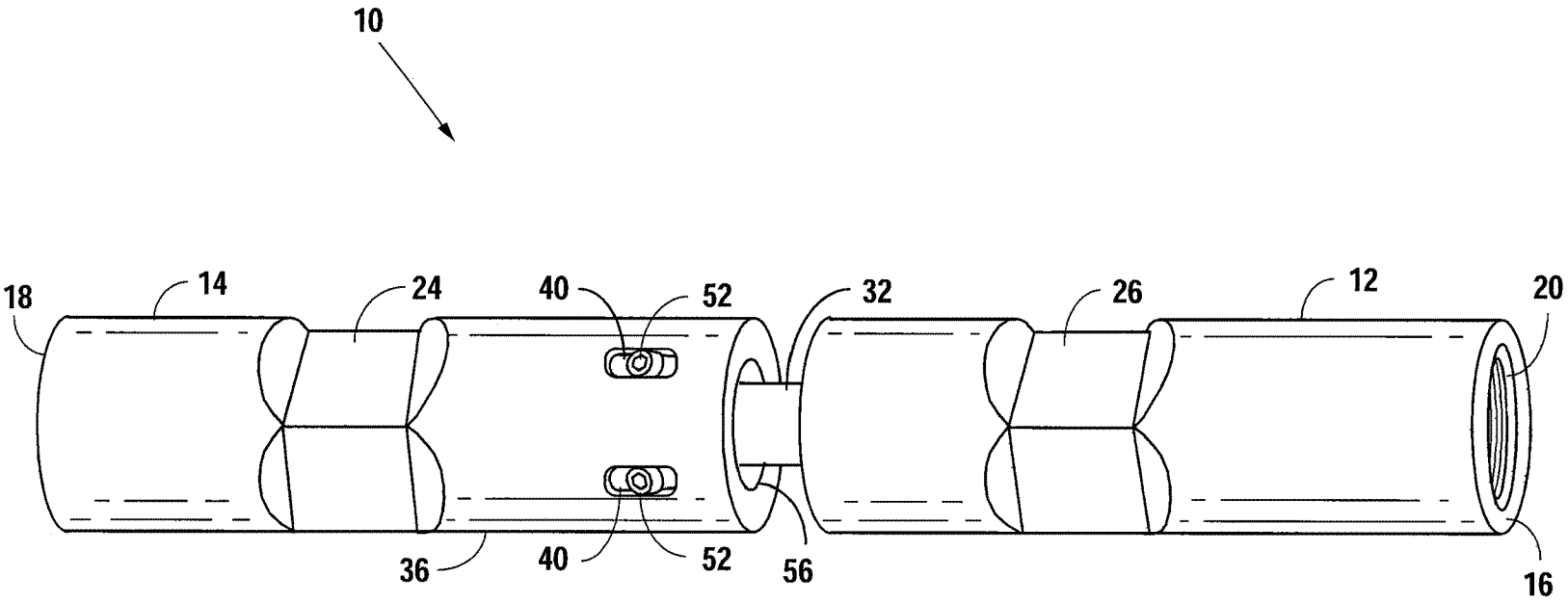
FIG. 1 is a side perspective view of the preferred embodiment of the flexible sucker rod coupling of the present invention.
Figure 2:
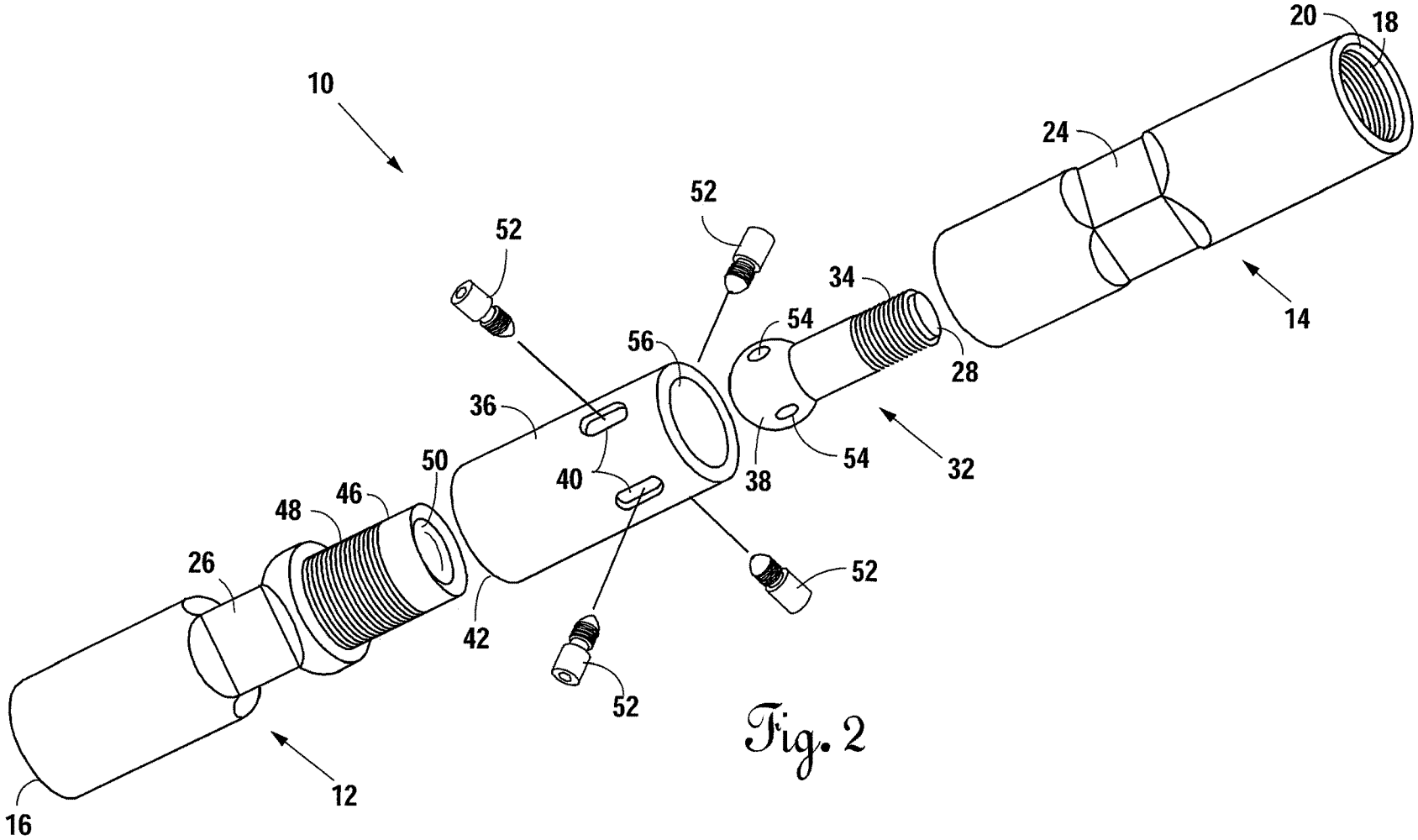
FIG. 2 is an exploded view of the present invention.
Figure 3:
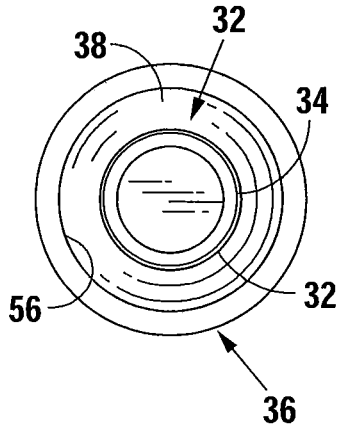
FIG. 3 is an end view of the ball and socket interaction within the ball shank housing member of the present invention.
Figure 3A:
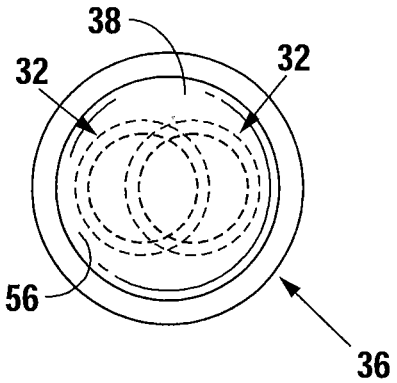
FIG. 3A is an end view of the ball shank housing of the present invention.
Figure 3B:
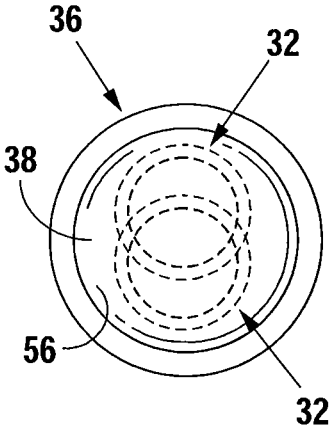
FIG. 3B is an end view of the ball shank housing of the present invention.

Referring to FIGS. 1 through 6, the system for relieving lateral stress placed on rods within a wellbore is disclosed. Referring to FIGS. 1 and 2, the preferred embodiment of the flexible sucker rod coupling 10 of present invention is disclosed. The flexible sucker rod coupling 10 comprises a top connecting member 12, a ball shank housing 36 for receiving a ball shank 32 therein, and a bottom connecting member 14. Referring to FIG. 2, the top connecting member 12 comprises a top end which, along the top edge defines a sucker rod connecting member 16. Sucker rod connecting member 16 comprises a recessed shoulder (not shown) along the top portion thereof, which receives an adjacent sucker rod inwards towards the interior of top connecting member 12, and terminates in a plurality of threads (not shown). The recess shoulder and threads of sucker rod connecting member 16 of top connecting member 12 are substantially similar to those shown as recessed shoulder 20 and threads defined buy sucker rod connecting member 18 of bottom connecting number 14.

The shoulders of both top connecting member and bottom connecting member 20 are designed to receive the collared portion of an adjacent sucker rod above its external threads (not shown) to shoulder the load of the sucker rod with respect to the flexible sucker rod coupling 10. Top connecting member 12 is substantially cylindrical shaped and is designed to fit within the tubing of the well bore (not shown) and to rotate therein while being pumped up hole and downhole by the pump jack (not shown). In fact, the entire flexible sucker rod coupling 10 of the present invention, it should be understood by one of skill in the art, is of a sufficient diameter to fit within the tubing of the well bore and still provide the lateral and swiveling movements as provided herein.

Top Connecting member 12 comprises a substantially cylindrical shaped outer surface which recesses along its middle portion to define wrench flat 26. Wrench flat 26 comprises a plurality of flat surfaces along a recess portion of the outer surface of the top connecting member 12, wherein the plurality of flat surfaces are adjacent to one another to receive a tool such as a wrench to grip top connecting member 12 to attach the flexible sucker rod coupling 10 of the present invention to adjacent sucker rods (not shown). In the preferred embodiment, the wrench flats 24 and 26 form a cube like structure defined by four flat services which are substantially perpendicular and adjacent one another to form the cube like shape shown. However, it should be understood by one of ordinary skill in the art that other designs or surfaces could be used to accommodate tools of different types to attach the flexible sucker rod coupling 10 of the present invention to adjacent sucker rods, and to threadedly attach the top connecting member 12 to the ball shank housing 36, and the ball shank housing 36 to the bottom connecting member 14.

Adjacently downhole from the wrench flats 26 of the top connecting member 12, there is a lower portion 46 which is substantially cylindrical shaped, and of slightly smaller diameter than the diameter of ball shank housing 36. The circumference of the lower portion 46 of top connecting member 12 is of an appropriate diameter to tightly threadedly attach to ball shank housing 36. Lower portion 46 comprises external threads along a predefined portion thereof. The internal portion of the lower end 46 of the top connecting member 12, along the lower edge thereof, comprises a socket 50. The socket is substantially concave structure located at the end of portion 46, and recesses within top connecting member 12 to provide a receiving site for the ball 38 of ball shank 32.

As shown in FIG. 2, ball shank housing 36 comprises a top end 42 which comprises internal threads (not shown) the internal threads are designed and located appropriately to receive substantially all of the external threads 48 of top connecting member 12. Ball shank housing 36 is a substantially cylindrically shaped hollow sleeve. The diameter of top end 42 of ball shank housing 36 is of the appropriate diameter such that the threads therein threadedly engage tightly with the external threads 48 of top connecting member 12. When the threads of top connecting member 12 are fully engaged with the internal threads of ball shank housing 36, the socket 50 of top connecting member 12 is located within ball shank housing 36 to receive ball 38, thereby forming a ball and socket joint to provide swiveling and/or lateral rotation within ball shank housing, as described further hereinbelow.

Ball shank 32 comprises a ball 38 along its top portion which engages with socket 50 as described hereinabove. The ball 38 comprises at least one, and preferably more than one threaded aperture 54. Threaded apertures 54 comprise internal threads which mate tightly with rotation screws 52. As shown, rotation screws 52 comprise a head portion which is designed for an allen screws. The alien screwdrivers (not shown) are used to tighten the screws 52 into the threaded apertures 54 of the ball. However, pins or other connecting members may be used other than screws 52. Furthermore, phillips or standard screw driving heads (not shown) can be used instead of alien heads for the screws 52.

Ball shank 32 comprises an extended shaft portion adjacent the ball 38 which extends downhole, extending out of the ball shank housing 36, while the ball shank 32 resides within ball shank housing 36. The shaft adjacent the ball 38 defines a lower portion and comprises external threads 34 along the lower portion thereof, and terminates with a ball shank locking thread 28. The ball shank locking thread 28 locks along a lock at a bottom internal surface of lower connecting member 14 (not shown).

Returning to the ball shank housing 36, as shown in FIGS. 2, 3, 3A and 3B, along the lower middle portion with respect to the longitudinal axis of the ball shank housing 36, a predefined number of slotted apertures 40 are disposed along the circumference thereof, and extending into the interior portion of the ball shank housing 36. At least one slotted aperture 40, but preferably more than one slotted aperture 40 may be located along the circumference of the ball shank housing 36. The slotted apertures 40 corresponding in number to the number of threaded holes 54 and ball shank 32 and a corresponding number of screws 52 are inserted within the apertures 40 and screwed into the threaded holes 54 of the head 38 of the ball shank 32. The screws 52 are designed to extend within the slotted apertures 40. As the sucker rod string (not shown) rotates, thereby rotating the flexible sucker rod coupling 10 of the present invention within the tubing, the screws 52 ensure that the ball shank 32 rotates correspondingly with the rotation of the flexible sucker rod coupling 10.

As shown most clearly in FIG. 1, the lower portion of ball shank 32 extends out of the lower end 56 of ball shank housing 36. The lower portion of ball shank 32 is of a smaller diameter than the hollow portion of the lower end 56 of 36, thereby defining a swivel gap to allow the ball shank to swivel and/or provide lateral movement with respect to top connecting member 12. As swiveling or lateral motion occurs, the ball 38 of the ball shank 32 swivels within socket 50 of top connecting member 12.

Returning to FIG. 2, the externally threaded portion 34 ball shank 32 threadedly attaches to lower connecting member 14. Internal threads along the top end of lower connecting member 14 are designed to tightly receive the external threads 34 of ball shank 32. Lower connecting member 14 is a substantially cylindrically shaped hollow tube with internal threads along the top portion thereof to receive and tightly engage with the external threads 34 ball shank 32. The lower or bottom connecting member 14 comprises a sucker rod connecting member 18 along the lower portion thereof, which comprises a shoulder 20 which leads to internal threads for receiving adjacent sucker rod (not shown). Like top connecting member 12, bottom connecting member 14 has a recessed portion defining wrench flats, which are the same or substantially the same shape, size and location of wrench flats 26 of top connecting member 12.

Referring to FIG. 4, an alternative embodiment of the present invention is disclosed. In the alternative embodiment, a central connecting member 76 has a recessed portion which provides a wrench flat similar to the wrench flats 26 and 24 of top connecting member 12 and bottom connecting member 14, respectively. On each end of central connecting member 76, external threads protrude there from (not shown) to engage internal threads (not shown) of ball shank housings 36. Each ball shank housing 36 has a ball shank 32 as previously described, which is mated internally within a socket (not shown). The lower portion of each ball shank 32 comprises external threads and are of a lesser diameter than the diameter of the lower end of ball shank housing 36 to define a swivel gap as described hereinabove.

Furthermore, each ball shank housing 36 comprises a plurality of slotted apertures 40 and screws 52 therein which engage within threaded holes 54 of the ball 38 of ball socket 32 as described herein above. The external threads 34 of the ball socket 32 engage internal threads 74 of wrench box ends 70 to tightly engage wrench box end 70 with ball shank 32. Wrench box ends 70 terminate with external threads 72 which are designed to engage pin sucker rod connectors, changed over boxes, or other couplings that may be attached to adjacent sucker rods (not shown).

Figure 5:
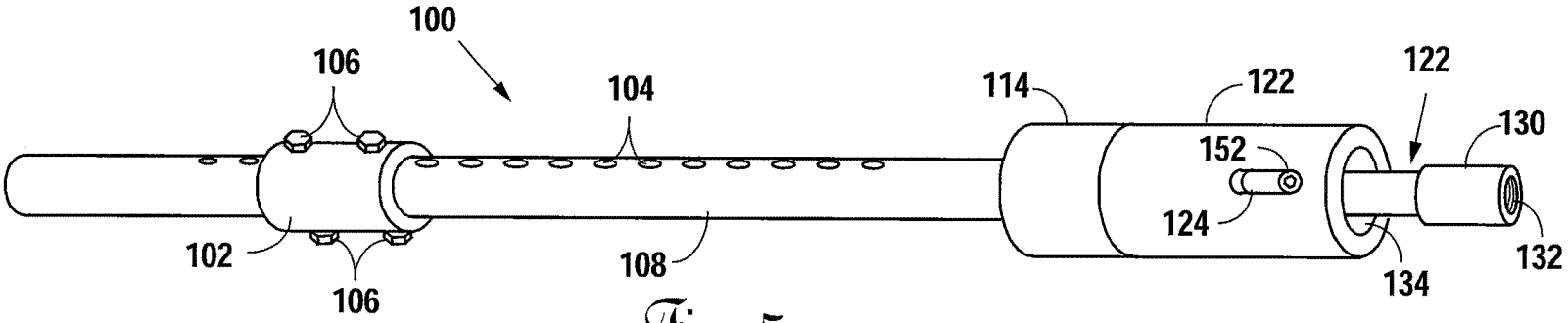
FIG. 5 is a side view of the adjustable adjustment housing of the present invention.
Figure 6:
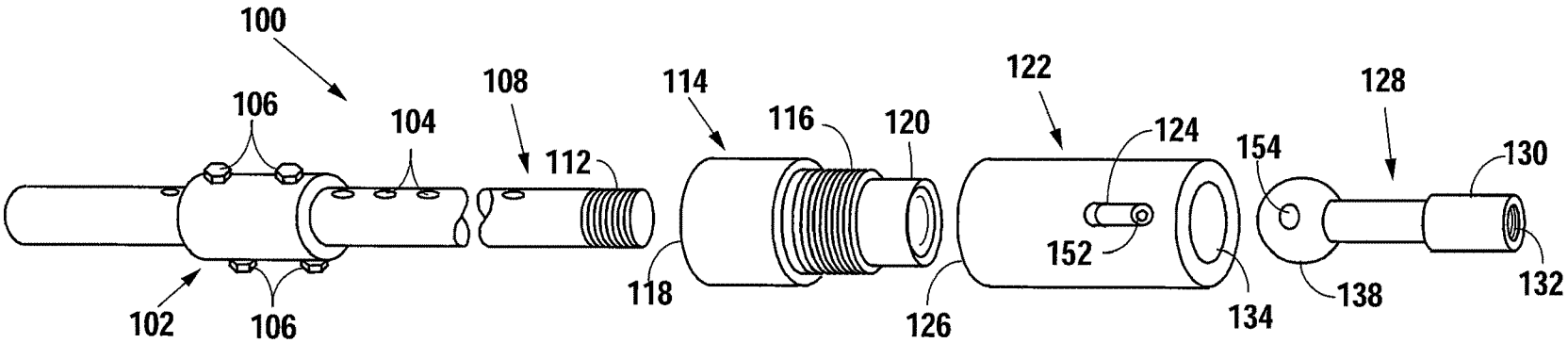
FIG. 6 is an exploded view of the adjustable adjustment housing of the present invention.

Turning to FIGS. 5 and 6, in another aspect of the present invention, and adjustment rod adjuster 100 that provides easy adjustability and a swivel gap to alleviate lateral stresses on an adjustment rod is disclosed. The adjustment rod adjuster 100 comprises a load adjustment housing 102 along a portion of a pickup adjustment rod 108. The load adjustment housing 102 is a substantially cylindrically shaped hollow tube which comprises at least one, and preferably more than one aperture there through for inserting pins 106. Pickup adjustment rod 108 comprises a plurality of apertures 104 that correspond to the apertures of load adjustment housing 102. The plurality of apertures 104 allow the load adjustment housing 102 to slide up and down the pickup adjustment rod 108 to the desired location and secured thereto with pins 106. The load adjustment housing 102 engages with the pump jack (not shown) to raise and lower pickup adjustment rod 108, thereby raising and lowering the polished rod and string of sucker rods (not shown).

Pickup adjustment rod 108 terminates along its lower portion with external threads 112 which are designed to engage internal threads 118 of an adjustment rod connector 114. Adjustment rod connector 114 comprises along its upper portion internal threads 118, and is substantially cylindrically shaped, and recesses in diameter along the lower portion thereof, defining external threads 116 thereon, and terminates with an internal socket 120. In one embodiment, external threads 116 tightly engage with a polished rod (not shown) to engage the adjustment rod adjuster 100 to the string of sucker rods inside wellbore.

However, in another embodiment, the adjustment rod connector 114 is threadedly engaged with its external threads 116 to internal threads 126 within a ball shank housing 122. Ball shank housing 122 has slotted apertures 124 and screws 152 as previously described herein to connect the ball 138 by engaging within threaded holes 154 of a ball shank 128. Ball shank 128 is disposed within ball shank housing 122, with the lower portion extended through the lower portion 134. The lower portion of ball shank 128 is of a lesser circumference than lower end 134 of ball shank housing 122, thereby defining a swivel gap as previously described hereinabove. Along its lower portion, ball shank 128 comprises a collar 130 which provides a connection site to a polished rod (not shown). The collar 130 terminates with internal threads 132 to threadedly attach the ball shank 128 to the polished rod, thereby providing lateral swivel with regard to the polished rod and the adjacent string of sucker rods.

Although the invention has been described with reference to specific embodiments and working examples herein, this description is not meant be construed in a limited sense various modifications of the disclosed embodiments as well as alternative embodiments of the invention will become apparent to persons skilled in the art upon reference to the description of the invention. It is therefore contemplated that the appended claims will cover such modifications that fall within the scope of the invention.

I claim:

1. A system for relieving lateral strain on a rod string within a wellbore comprising:

at least one flexible sucker rod connection assembly for attaching to adjacent sucker rods within said wellbore, said sucker rod connection assembly comprising:

a top connecting member adjacent and attached to a ball shank housing, said ball shank housing receiving a portion of a ball shank therein; and a bottom connecting member spaced from said ball shank housing, and connected to a lower portion of said ball shank; and an adjustable adjustment rod assembly attached to a polished rod of a pump jack above said wellbore, said adjustment rod system comprising:

an adjustment rod comprising external threads along a lower portion, said adjustment rod engaging with said polished rod and said pump jack a load adjustment housing receiving said adjustment rod and being slidable along a longitudinal axis of said adjustment rod and attachable thereto at a desired location; and an adjustment rod connector comprising internal threads on a top surface thereof, said internal threads threadedly engaging said external threads of said adjustment rod, and a lower portion comprising external threads.

2. The system for relieving lateral strain on a rod string as set forth in claim 1 wherein:

said top connecting member further comprises internal threads along an internal top portion thereof, external threads along an external lower portion thereof for threadedly attaching to said ball shank housing, and a bottom surface defining a recessed socket extending internally within said top connecting member, said socket engaging with a ball of said ball shank;

said ball of said ball shank being attached to said ball shank housing, and said ball shank further comprising a substantially cylindrically shaped lower portion comprising external threads and extending through a lower portion of said ball shank housing, defining a swivel gap between said ball shank housing and said lower portion of said ball shank; and said bottom connecting member comprises internal threads along an internal top portion thereof which engage said external threads of said ball shank, and internal threads along an internal bottom portion thereof.

3. The system for relieving lateral strain on a rod string as set forth in claim 2 wherein said ball shank housing comprises a plurality of slotted apertures extending there through, and a corresponding plurality of screws inserted within said slotted apertures and engaging a corresponding plurality of internal threads within said ball of said ball shank, said screws being slidable within said slotted apertures to provide controlled swiveling movement of said flexible sucker rod connection assembly within said swivel gap of said ball shank.

4. The system for relieving lateral strain on a rod string as set forth in claim 3 wherein said top connecting member and said bottom connecting member comprise recessed portions along their external surfaces, defining wrench flats.

5. The system for relieving lateral strain on a rod string as set forth in claim 1 wherein:

said adjustment rod comprises a plurality of apertures for attaching said load adjustment housing at said desired location;

said load adjustment housing comprises at least two apertures corresponding to at least two apertures of said adjustment rod, and at least two pins extending through said apertures of said load adjustment housing and said at least two apertures of said adjustment rod.

6. The system for relieving lateral strain on a rod string as set forth in claim 4 wherein:

said adjustment rod comprises a plurality of apertures for attaching said load adjustment housing at said desired location; and said load adjustment housing comprises at least two apertures corresponding to at least two apertures of said adjustment rod, and at least two pins extending through said apertures of said load adjustment housing and said at least two apertures of said adjustment rod.

7. The system for relieving lateral strain on a rod string as set forth in claim 1 wherein said adjustment rod assembly comprises a ball shank comprising a ball and a lower portion, said ball of said ball shank disposed within a ball shank housing, and said lower portion extending through the bottom of said ball shank housing, defining a swivel gap between said ball shank housing and said lower portion of said ball shank;

wherein said ball shank comprises a collar along said lower portion, and internal threads along an internal bottom portion; and said ball shank housing comprises a plurality of slotted apertures extending there through, and a corresponding plurality of screws inserted within said slotted apertures and engaging a corresponding plurality of internal threads within said ball of said ball shank, said screws being slidable within said slotted apertures to provide controlled swiveling movement within said swivel gap of said ball shank.

8. The system for relieving lateral strain on a rod string as set forth in claim 4 wherein said adjustment rod assembly comprises a ball shank comprising a ball and a lower portion, said ball of said ball shank disposed within a ball shank housing which is attached to said adjustment rod connector, and said lower portion extending through the bottom of said ball shank housing, defining a swivel gap between said bottom of said ball shank housing and said lower portion of said ball shank.

9. The system for relieving lateral strain on a rod string as set forth in claim 8 wherein said ball shank comprises a collar along said lower portion, and internal threads along an internal bottom portion;

said ball shank housing comprises internal threads disposed internally along an upper portion of said ball shank housing for receiving said external threads of said adjustment rod connector, a plurality of slotted apertures extending there through, an a corresponding plurality of screws inserted within said slotted apertures and engaging a corresponding plurality of internal threads within said ball of said ball shank, said screws being slidable within said slotted apertures to controlled provide swiveling movement within said swivel gap of said ball shank.

10. A system for adjusting the engagement of a polished rod with a pump jack comprising an adjustment rod comprising external threads along a lower portion, a load adjustment housing receiving said adjustment rod and being slidable along a longitudinal axis of said adjustment rod and attachable thereto at a desired location; and an adjustment rod connector comprising internal threads on a top surface thereof, said internal threads threadedly engaging said external threads of said adjustment rod, and a lower portion comprising external threads, a ball shank comprising a ball and a lower portion, said ball of said ball shank disposed within a ball shank housing which is attached and adjacent said adjustment rod connector, and said lower portion extending through the bottom of said ball shank housing, defining a swivel gap between said ball shank housing and said lower portion of said ball shank;

said ball shank housing comprising internal threads along an internal top portion thereof for receiving said external threads of said adjustment rod, and wherein said ball shank comprises a collar along said lower portion, and internal threads along an internal bottom portion.

11. The system as set forth in claim 10 wherein said ball shank housing comprises a plurality of slotted apertures extending there through, an a corresponding plurality of screws inserted within said slotted apertures and engaging a corresponding plurality of internal threads within said ball of said ball shank, said screws being slidable within said slotted apertures to provide controlled swiveling movement within said swivel gap of said ball shank.

12. The system as set forth in claim 11 wherein:

said adjustment rod comprises a plurality of apertures for attaching said load adjustment housing as said desired location; and said load adjustment housing comprises at least two apertures corresponding to at least two apertures of said adjustment rod, and at least two pins extending through said apertures of said load adjustment housing and said at least two apertures of said adjustment rod.

13. An apparatus for relieving lateral strain between two rods within a wellbore, said apparatus comprising:

a top connecting member;

a ball shank housing attached to said top connecting member along a bottom portion thereof, said ball shank housing receiving a portion of a ball shank therein; and a bottom connecting member spaced from said ball shank housing, and connected to a lower portion of said ball shank;

wherein said ball shank housing comprises a plurality of slotted apertures extending there through, a corresponding plurality of screws inserted within said slotted apertures and engaging a corresponding plurality of internal threads within a ball of said ball shank, said screws being slidable within said slotted apertures to provide controlled swiveling movement within a swivel gap defined by a space between said lower portion of said ball shank and said ball shank housing.

14. The apparatus for relieving lateral strain between two rods as set forth in claim 13 wherein:

said top connecting member further comprises internal threads along an internal top portion thereof, external threads along an external lower portion thereof for threadedly attaching to said ball shank housing, and a bottom surface defining a recessed socket extending internally within said top connecting member, said socket engaging with said ball of said ball shank; and said bottom connecting member comprises internal threads along an internal top portion thereof which engage said external threads of said ball shank, and internal threads along an internal bottom portion thereof.

15. The apparatus for relieving lateral strain between two rods as set forth in claim 14 wherein said top connecting member and said bottom connecting member comprise recessed portions along their external surfaces, defining wrench flats.

* * * * *